United States Patent [19]

Ott

[11] 3,947,719

[45] Mar. 30, 1976

[54] FILTERED FLUORESCENT LAMP

[75] Inventor: John Nash Ott, Sarasota, Fla.

[73] Assignee: John Ott Laboratories, Inc., Sarasota, Fla.

[22] Filed: June 2, 1975

[21] Appl. No.: 583,195

Related U.S. Application Data

[63] Continuation of Ser. No. 456,272, March 29, 1974, abandoned.

[52] U.S. Cl. ..... 313/489; 313/112; 313/220; 313/493

[51] Int. Cl.[2] ..... H01J 61/40; H01J 1/70

[58] Field of Search ..... 313/110, 112, 220, 221, 313/485, 486, 487, 489, 493

[56] References Cited

UNITED STATES PATENTS

| | | | |
|---|---|---|---|
| 2,205,809 | 6/1940 | Breadner et al. | 313/489 |
| 2,238,784 | 4/1941 | Scott et al. | 313/489 |
| 2,355,258 | 8/1941 | Biggs et al. | 313/112 X |
| 2,413,940 | 1/1947 | Bickford | 313/487 |
| 3,148,300 | 9/1964 | Graff | 313/221 |

*Primary Examiner*—Alfred E. Smith
*Assistant Examiner*—E. R. LaRoche
*Attorney, Agent, or Firm*—Richard E. Hosley

[57] ABSTRACT

A light filtering system for improving the spectral output from fluorescent lamps. A filter placed within the lamp envelope between the phosphor coating and the arc discharge path between the lamp electrodes, absorbs mercury arc radiation in the visible range while passing arc radiation in the ultraviolet range to excite the phoshor coating and produce visible light emitted through the outer envelope.

4 Claims, 6 Drawing Figures

FILTERED FLUORESCENT LAMP

This is a continuation of application Ser. No. 456,272, filed Mar. 29, 1974, now abandoned.

BACKGROUND OF THE INVENTION

This invention relates to fluorescent gaseous discharge lamps of the type commonly used as a source of artificial illumination and, more particularly, to a filtering system for improving the spectral output of such lamps.

Fluorescent lamps in common use today comprise a tubular envelope with electron-emitting electrodes at each end. The envelope is filled with a low pressure ionizable medium such as mercury vapor and a rare gas such as argon. When a suitable voltage is applied to the electrodes, an electrical discharge takes place in the mercury vapor which produces resonance radiation of the ionized mercury. This radiation occurs at a number of different wavelengths characteristic of mercury often referred to as the mercury lines. Part of this radiation is in the ultraviolet range and part is in the visible range. The ultraviolet part excites a phosphor coating on the inside of the lamp envelope which fluoresces to produce visible light emitted by the lamp. The lamp envelope is designed to attenuate a substantial portion of the ultraviolet emitted by the mercury arc which may be harmful and to pass the visible light from the irradiated phosphor coating. However, the lamp envelope also passes the mercury art radiation in the visible range which causes distortion in the spectral light energy distribution curve of the lamp.

It is believed that the spectral distortions in the light output of fluorescent lamps caused by mercury radiation are a form of light pollution which may produce undesirable biological effects in plants, animals and man. Research done in this field indicates that natural light from the sun is a very important factor affecting life on earth and that artificial light sources should approach natural daylight in spectral distribution as closely as possible. For that reason it is desirable to eliminate from the light output of fluorescent lamps the spectral distortions caused by mercury radiation so that the lamp produces light with a smooth spectral energy distribution curve more nearly resembling natural daylight.

Accordingly, it is an object of this invention to provide an improved fluorescent lamp producing a light output which is free of the spectral distortions caused by arc radiation.

A further object of the invention is to provide a filtering system for a fluorescent lamp which prevents mercury arc radiation in the visible range from passing outside of the lamp without interfering with the ultraviolet radiation which excites the phosphor coating on the lamp envelope to produce the desired light output of the lamp.

Further objects and advantages of the invention will become apparent as the following description proceeds.

SUMMARY

Briefly, in accordance with the invention a radiation filter is placed within the envelope of a fluorescent tube so that it lies between the mercury arc discharge path and the phosphor coating on the envelope. The filter comprises a material that passes radiation in the ultraviolet range and absorbs radiation in the visible range while the filtering provided by the lamp envelope has the opposite effect. Due to the combined filtering action of the filter and the lamp envelope, the mercury arc radiation in the visible range is attenuated by the filter while the mercury arc radiation in the ultraviolet range is passed through the filter to excite the phosphor coating. Visible light from the phosphor coating is passed by the lamp envelope but ultraviolet radiation from the mercury arc is attenuated so that only the visible light from the phosphor coating is emitted by the lamp. Thus spectral distortions in the visible light output, which would otherwise be caused by the mercury arc radiation, are eliminated.

For a better understanding of the invention, reference should be to the following detailed description taken in connection with the accompanying drawings.

DESCRIPTION OF ILLUSTRATED EMBODIMENTS

Figure 1:
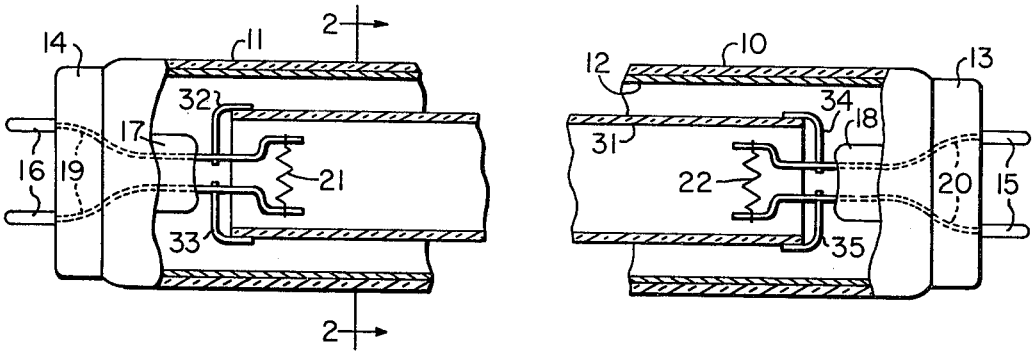
FIG. 1 is a longitudinal sectional view of a fluorescent lamp provided with a filtering system in accordance with the present invention.
Figure 2:
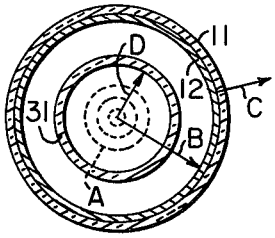
FIG. 2 is a cross sectional view of the lamp of FIG. 1 looking in the direction of the arrows 2—2.

Referring to FIG. 1, there is shown a fluorescent lamp 10 comprising an elongated tubular envelope 11 which is sealed and evacuated. The envelope is made of a suitable material, usually glass, and contains a fill of an inert gas such as argon and a small quantity of an ionizable material such as mercury so that the lamp can be operated at a low mercury vapor pressure usually in the range of 2 to 12 microns. In accordance with the usual commercial practice, the entire inner wall of the envelope is provided with a coating 12 of known phosphor materials having a composition selected to produce the desired visible light spectrum when excited by ultraviolet radiation from the lamp arc.

The envelope 11 is provided with base fixtures 13 and 14 at each end on which are mounted terminal pins 15 and 16. The ends of the envelope 11 are sealed by stems 17 and 18 through which extend lead-in wires 19 and 20 connected to the pins 15 and 16. Supported from the inner ends of the wires 19 and 20 are cathode electrodes 21 and 22 in the form of a coil extending between the inner ends of the lead-in wires. As is well understood in the art, these electrodes are coated with suitable electron-emitting material such as alkaline earth oxides and may be heated to facilitate starting of the lamp by passing an electric current therethrough. When a suitable starting voltage is applied across the electrodes, an arc discharge takes place through the mercury vapor producing resonance radiation of the ionized mercury. This radiation excites the phosphor coating 12 to produce visible light in a well known manner.

Figure 4:
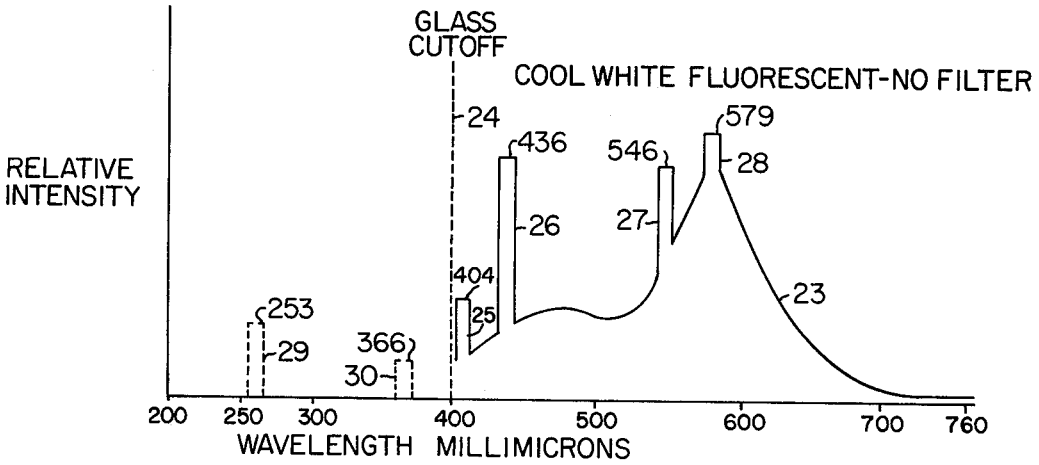
FIGS. 4 and 5 are graphical representations showing the spectral energy distribution curves of a fluorescent lamp useful in explaining the operation of the invention.

The resonance radiation of the mercury arc occurs at a number of different wavelengths which are characteristic of mercury vapor. These are illustrated in FIG. 4 which, for example, shows a typical spectral energy distribution curve 23 for a cool white fluorescent lamp. The vertical dash line 24 is placed at a cutoff wavelength for the glass envelope 11 which is usually in the neighborhood of 400 millimicrons. At wavelengths in the visible range above 400 millimicrons the mercury radiation causes distortions in the curve 23 illustrated by the peaks 25, 26, 27 and 28 occurring respectively at 404, 436, 546 and 579 millimicrons. In the ultraviolet range below 400 millimicrons mercury radiation also occurs at 253 and 366 millimicrons. This is illustrated by peaks 29 and 30. These are shown as dotted lines since they do not radiate from the lamp being attenuated by the glass envelope 11. The mercury radiation at 253 millimicrons from the low pressure mercury discharge is the one primarily absorbed by the phosphor coating 12 to produce visible light in the usual fluorescent lamp.

The fluorescent lamp as thus far described is of conventional construction. In operation, it has a visible light output curve, such as curve 23, which is distorted because of mercury arc radiation passed by the envelope 11 as illustrated by the peaks 25, 26, 27 and 28. It is noted that the mercury vapor lines or peaks are conventionally represented in FIG. 4 at 100 times their true width and at only 1/100 of their true intensity for convenience in graphical representation. Thus the mercury vapor radiation peaks are actually much higher than shown as would appear if they were shown as monochromatic lines rather than averaged over a 10 millimicron band. For the reasons pointed out above, these distortions are undesirable. In accordance with the invention, they are eliminated by a filtering system which will now be described.

Mounted within the envelope 11 so as to lie between the arc discharge path between electrodes 21 and 22 and the phosphor coating 12 is a tubular glass filter member 31. The filter member is centrally supported in a position spaced from the side walls of the envelope 11 so that it surrounds both electrode 21 and 22 and the arc discharge path therebetween. As shown, the filter is supported in this position by metallic wires 32, 33, 34 and 35 extending between the ends of the filter and the lead-in wires 19 and 20 and attached thereto in any suitable manner as by fusing to the filter and welding to the wires.

Figure 5:
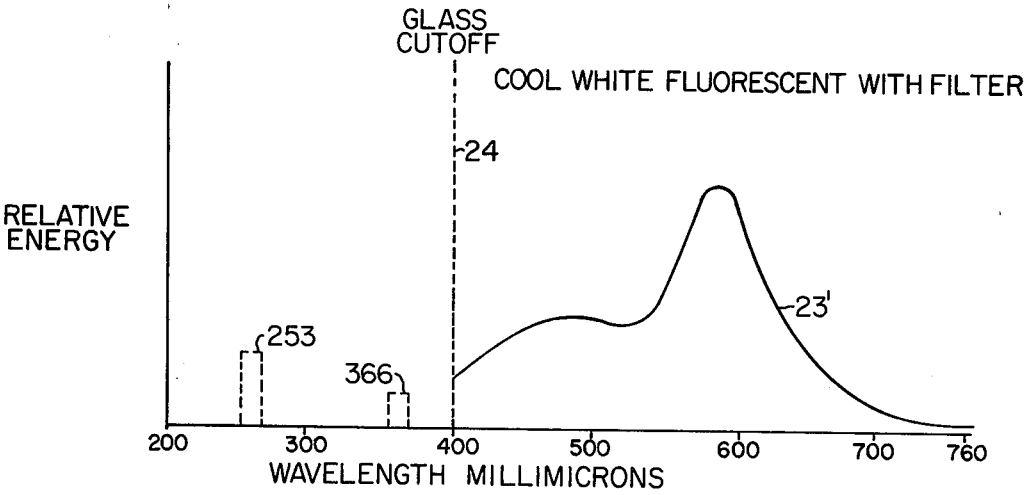

The filter member 31 is constructed of a glass or other suitable filter material that will pass ultraviolet radiation B from the mercury arc A, primarily the 253 millimicron radiation, so that it can excite the phosphor coating 12 to produce visible light C. The filter material absorbs most of the mercury arc radiation D in the visible range above 400 millimicrons, and in this way substantially eliminates the distortion peaks 25, 26, 27 and 28 shown in FIG. 4. The result is a smooth spectral energy distribution curve 23[1] shown in FIG. 5 which more nearly resembles the smooth spectral energy distribution curve of natural daylight. The ultraviolet radiation B from the mercury arc at 253 and 366 millimicrons wavelengths passed by the filter member 31 is not emitted by the lamp since it is absorbed by the glass envelope 11.

Figure 3:
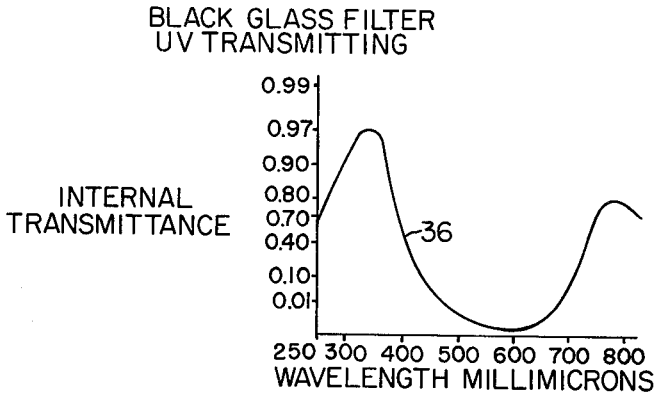
FIG. 3 is a graphical representation showing the radiation transmission characteristics of the filter.

The radiation transmission characteristics of one suitable material for the filter 31 are shown in FIG. 3. This material is a black glass UV transmitting filter known as an "Ealing" filter manufactured by the Ealing Corporation, Optics Division, 2225 Massachusetts Ave., Cambridge, Mass. 02140 and identified by their catalog number 26–5553. The curve 36 shows the internal transmittance characteristic of this material for various wavelengths in the visible and ultraviolet ranges. Referring to this curve, it will be noted that the absorption band for the visible region is only about 40 percent transmissive at 400 millimicrons wavelength and is less than 10% transmissive through most of its range including the significant mercury arc radiation at 436, 546 and 579 millimicrons wavelength. On the other hand, in the pass band for the 256 and 366 phosphor-excitation mercury arc radiation the transmission is 70 percent or greater.

Figure 6:
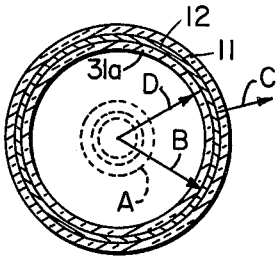
FIG. 6 illustrates a modified form of the lamp shown in FIG. 1.

In FIG. 6 there is shown a modified form of the lamp construction of FIG. 1. Here the filter member 31*a* has a large diameter so that it abuts the phosphor coating 12 on the inner wall of the envelope 11 forming a laminated construction. Although the filtering action is essentially the same, this construction has the advantage that no supporting wires are required to hold the filter in position, the supporting function being performed by the outer envelope 11. Also with this arrangement the entire space containing the ionized mercury vapor is enclosed by the filter material thus insuring that all of the arc radiation will be filtered.

While the filter 31 is illustrated as being made of glass, it may be made of other materials. Thus it may be made of one or more powders having suitable radiation absorption characteristics carried on a substrate transparent to ultraviolet radiation.

As will be apparent to those skilled in the art, the invention is not limited to a tubular fluorescent lamp of the type illustrated. The envelopes may have other shapes and may, for example, be in the shape of a bulb with suitable phosphor and filtering materials on the inside of the bulb. Also, the invention may be applied to lamps utilizing phosphors or fluorescent materials as light transformers wherein the arc discharge occurs in other metallic vapors which produce distortions in the light output of the lamp.

The invention is also well adapted for application to special fluorescent lamps utilizing a phosphor blend designed to simulate daylight more closely than the cool white type illustrated. Such a lamp is disclosed, for example, in U.S. Pat. No. 3,670,193. Because the filtering system of the present invention eliminates the metallic vapor radiation peaks which distort the light output, the result is a closer approach to natural daylight than has heretofore been possible with artificial light sources.

What is claimed as new and desired to be secured by Letters Patent of the United States is:

1. In a fluorescent lamp the combination comprising:;

a. an envelope having a phosphor coating thereon, b. an ionizable medium within said envelope, c. a pair of electrodes mounted within said envelope between which an arc discharge occurs upon operation of the lamp, and d. filtering means arranged to extend between said phosphor coating and the path of said arc discharge, said filtering means comprising a material which has an internal transmittance with respect to arc radiation passing therethrough of not less than 70 percent in the ultraviolet phosphor-excitation range and not more than 40 percent in the visible range whereby the filtering means passes ultraviolet radiation from said arc discharge which excites said phosphor coating to produce visible light while substantially attenuating radiation from said arc discharge in the visible range which would otherwise cause spectral distortion in the light output of the lamp.

2. The fluorescent lamp of claim 1 wherein the filtering means comprises a tubular member arranged to surround the electrodes and the arc discharge path therebetween.

3. The fluorescent lamp of claim 1 wherein the envelope is formed of a material which transmits visible light while substantially attenuating radiation from the arc discharge in the ultraviolet range which is passed by the filtering means.

4. The fluorescent lamp of claim 1 wherein the ionizable medium comprises mercury vapor and the filtering means substantially attenuates mercury vapor radiation having a wave length greater than approximately 400 millimicrons while passing mercury vapor radiation having a wavelength less than 400 millimicrons.

* * * * *